US011261712B2

(12) United States Patent
Muraikhi

(10) Patent No.: US 11,261,712 B2
(45) Date of Patent: Mar. 1, 2022

(54) SYSTEM AND METHOD FOR AUTOMATED WELL ANNULUS PRESSURE CONTROL

(71) Applicant: Saudi Arabian Oil Company, Dhahran (SA)

(72) Inventor: Abdullah I. Muraikhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 28 days.

(21) Appl. No.: 16/855,783

(22) Filed: Apr. 22, 2020

(65) Prior Publication Data

US 2021/0332652 A1 Oct. 28, 2021

(51) Int. Cl.

| | |
|---|---|
| ***E21B 43/12*** | (2006.01) |
| ***E21B 21/08*** | (2006.01) |
| ***E21B 33/068*** | (2006.01) |
| ***E21B 47/06*** | (2012.01) |

(52) U.S. Cl.

CPC ..... *E21B 43/12* (2013.01); *E21B 21/08* (2013.01); *E21B 33/068* (2013.01); *E21B 47/06* (2013.01)

(58) Field of Classification Search

CPC ..... E21B 21/08; E21B 47/06; E21B 33/068; E21B 43/12; E21B 34/02; E21B 2200/20

See application file for complete search history.

(56) References Cited

U.S. PATENT DOCUMENTS

| | | | |
|---|---|---|---|
| 5,273,112 | A | 12/1993 | Schultz |
| 6,575,244 | B2 | 6/2003 | Chang et al. |
| 7,441,599 | B2 | 10/2008 | Hermes et al. |
| 7,836,973 | B2 | 11/2010 | Belcher et al. |
| 8,353,351 | B2 | 1/2013 | Carpenter et al. |
| 8,528,660 | B2 | 9/2013 | Santos |
| 9,388,653 | B2 | 7/2016 | Hufthammer |
| 9,695,655 | B2 | 7/2017 | Kaasa et al. |

(Continued)

FOREIGN PATENT DOCUMENTS

WO 2019139664 A1 7/2019

OTHER PUBLICATIONS

"Absolution Which Enables Continued Safe Production in Wells with Unplanned TCA or CCA Pressure", Petroleum Technology Company, 2016, 2 pages.

(Continued)

*Primary Examiner* — Brad Harcourt
(74) *Attorney, Agent, or Firm* — Bracewell LLP; Constance G. Rhebergen; Vivek P. Shankam

(57) ABSTRACT

A well annulus pressure control system includes a reservoir in fluid communication with a well annulus, a control valve disposed on a fluid coupling between the reservoir and well annulus, a sensor disposed in the well annulus that detects a well annulus pressure, a controller that is operatively coupled to the control valve and sensor. The controller detects the well annulus pressure of the fluid in the well annulus based on sensor data from the sensor, controls the control valve to release the fluid from the well annulus into the reservoir in response to determining that the detected well annulus pressure is higher than a normal operating range of pressure in the well annulus, and controls the control valve to refill the fluid from the reservoir back into the well annulus in response to determining that the detected well annulus pressure is lower than the normal operating range.

33 Claims, 5 Drawing Sheets

(56) References Cited

U.S. PATENT DOCUMENTS

| | | | | |
|---|---|---|---|---|
| 2005/0092523 | A1 | 5/2005 | McCaskill et al. | |
| 2007/0151762 | A1* | 7/2007 | Reitsma | E21B 21/08 175/40 |
| 2009/0288821 | A1* | 11/2009 | Eriksen | E21B 21/06 166/250.01 |
| 2012/0090893 | A1* | 4/2012 | Leuchtenberg | E21B 21/08 175/25 |
| 2012/0227961 | A1* | 9/2012 | Sehsah | E21B 21/08 166/250.07 |
| 2019/0153821 | A1 | 5/2019 | Douglas et al. | |
| 2020/0040677 | A1* | 2/2020 | Spencer | E21B 21/106 |

OTHER PUBLICATIONS

Equinor Energy AS et al.,"Annulus Pressure Management For Subsea Wells", www.researchdisclosure.com, Research Disclosure Database vol. 664, No. 23, Kenneth Mason Publications, UK, Aug. 1, 2019, 3 pages.

Hans-Emil Bensnes Torbergsen et al., "An Introduction to Well Integrity", Norwegian University of Science and Technology, www.norskoljeoggass.no, Dec. 4, 2012, 154 pages.

PCT International Search Report and The Written Opinion of The International Searching Authority dated Jul. 27, 2021, for PCT/US2021/070441, 14 pages.

* cited by examiner

SYSTEM AND METHOD FOR AUTOMATED WELL ANNULUS PRESSURE CONTROL

TECHNICAL FIELD

Embodiments relate generally to well integrity, and more particularly to automatically controlling well annulus pressure to maintain well integrity.

BACKGROUND

A rock formation that resides under the Earth's surface is often referred to as a "subsurface" formation. A subsurface formation that contains a subsurface pool of hydrocarbons, such as oil and gas, is often referred to as a "hydrocarbon reservoir." Hydrocarbons are typically extracted (or "produced") from a hydrocarbon reservoir by way of a hydrocarbon well. A hydrocarbon well normally includes a wellbore (or "borehole") that is drilled into the reservoir. For example, a hydrocarbon well may include a wellbore that extends into the rock of a reservoir to facilitate the extraction (or "production") of hydrocarbons from the reservoir, the injection of fluids into the reservoir, or the evaluation and monitoring of the reservoir.

Well integrity refers to application of technical, operational and organizational solutions to reduce risk of uncontrolled release of formation fluids or hydrocarbons throughout the life cycle of a hydrocarbon well. One solution to preserve well integrity involves managing pressure within a well annulus of the hydrocarbon well. Annular pressure is generated when annular fluids are heated by production and expand, causing the pressure in the well annulus to rise. It is important maintain the annulus pressure within the well's mechanical design limits so as to ensure that the annulus pressure does not challenge or otherwise compromise the well's integrity during the life of the well. Allowing annulus pressure to go outside of acceptable operating limits may result in a variety of well integrity problems (e.g., tubing, casing, packer, or downhole equipment failure), which could have catastrophic consequences. Annulus pressure may be relieved by opening a valve coupled to the annulus and venting the pressure to outside of the annulus. However, conventional annulus pressure control techniques require costly human interaction and surveillance, resulting from scheduled or un-scheduled visits to remote wells or offshore platforms.

SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the disclosed subject matter or to delineate the scope of the disclosed subject matter. Its sole purpose is to present some concepts in a simplified form as a prelude to the more detailed description that is discussed later.

In one embodiment, a well annulus pressure control system includes a reservoir that is in fluid communication with a well annulus of a well; at least one control valve that is disposed on at least one fluid coupling between the reservoir and the well annulus; at least one sensor that is disposed in the well annulus and that is configured to detect a well annulus pressure of fluid in the well annulus; and a controller that is operatively coupled to the at least one control valve and the at least one sensor, wherein the controller is configured to: detect the well annulus pressure of the fluid in the well annulus based on sensor data from the at least one sensor; control the at least one control valve to release the fluid from the well annulus into the reservoir in response to determining that the detected well annulus pressure is higher than a normal operating range of pressure in the well annulus; and control the at least one control valve to refill the fluid from the reservoir back into the well annulus in response to determining that the detected well annulus pressure is lower than the normal operating range of pressure in the well annulus.

In another embodiment, a well annulus pressure control method includes detecting a well annulus pressure of fluid in a well annulus of a well based on sensor data from at least one sensor; controlling at least one control valve to release the fluid from the well annulus into a reservoir in response to determining that the detected well annulus pressure is higher than a normal operating range of pressure in the well annulus; and controlling the at least one control valve to refill the fluid from the reservoir back into the well annulus in response to determining that the detected well annulus pressure is lower than the normal operating range of pressure in the well annulus.

In yet another embodiment, the well annulus pressure control method may be embodied in computer executable program code and stored in a non-transitory storage device.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

Figure 1:
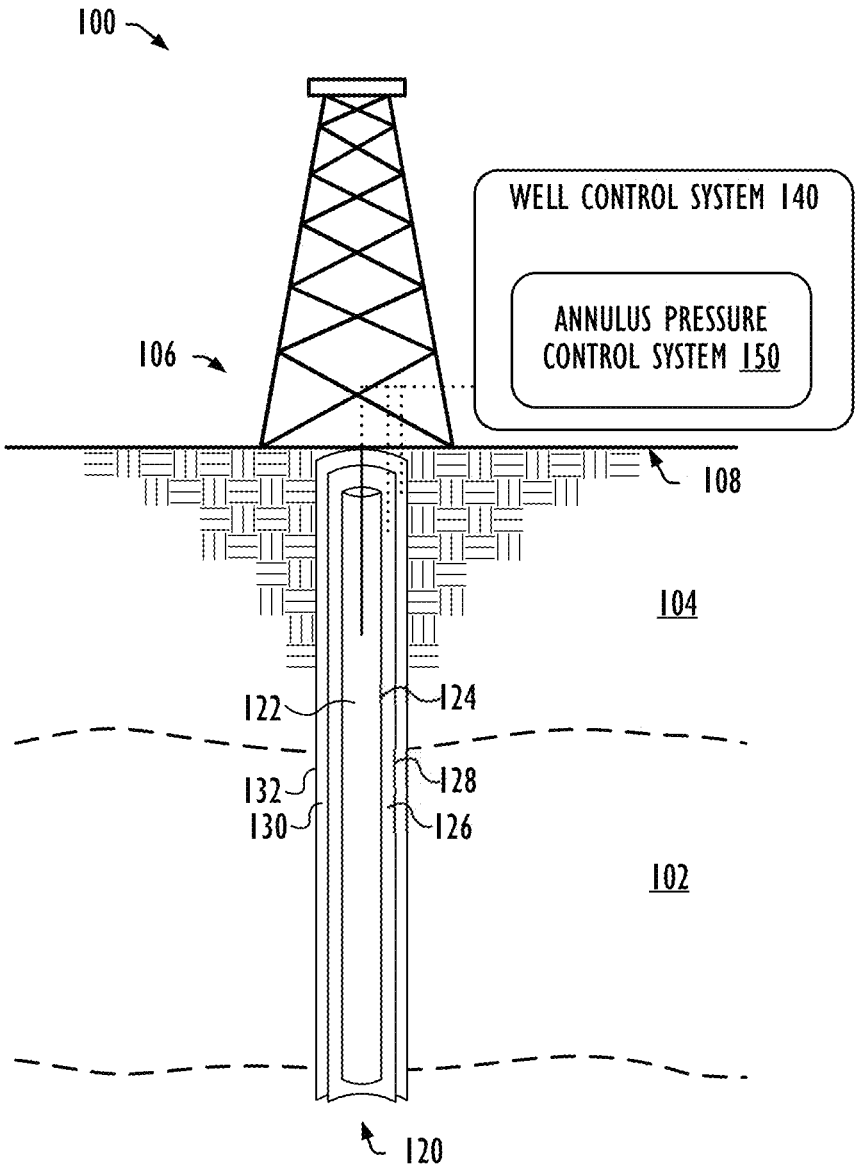
FIG. 1 is a schematic diagram of a well environment in accordance with one or more embodiments.

While certain embodiments will be described in connection with the illustrative embodiments shown herein, the subject matter of the present disclosure is not limited to those embodiments. On the contrary, all alternatives, modifications, and equivalents are included within the spirit and scope of the disclosed subject matter as defined by the claims. In the drawings, which are not to scale, the same reference numerals are used throughout the description and in the drawing figures for components and elements having the same structure.

DETAILED DESCRIPTION

In the following description, for purposes of explanation, numerous specific details are set forth in order to provide a thorough understanding of the inventive concept. In the interest of clarity, not all features of an actual implementation are described. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" or "another embodiment" means that a particular feature, structure, or characteristic described in connection with the embodiment is included in at least one embodiment of the disclosed subject matter, and multiple references to "one embodiment" or "an embodiment" or "another embodiment" should not be understood as necessarily all referring to the same embodiment.

This disclosure pertains to an annulus pressure control system for automatically maintaining pressure in the well annulus to maintain well integrity and prevent damage to well components like the downhole packer, tubing, tubing hanger, and casing. Techniques disclosed herein look to implement a well annulus 'breathing box' at an onshore well (or at an offshore platform of an offshore well) which may include components like a reservoir tank, piping, valves, gauges, sensors, pump, and control system. The breathing box (e.g., relief equipment) storage tank may be communicatively coupled to the well annulus via the valves and pump so that when predetermined high annulus pressure and time conditions are satisfied, an outgoing valve may open to bleed off excess well annulus fluid from the annulus into the external reservoir tank. Conversely, when predetermined low annulus pressure and time conditions are met, an incoming valve may open and fluid (e.g., diesel) from the tank may be pumped back into the well annulus to maintain the pressure level within the well annulus between predetermined high and low pressure levels. The annulus pressure control system may be configured to communicate with a remote operator to transmit data of the behavior of the well, corresponding automated fluid bleed or refill operations performed, and any error conditions detected during the automated annular pressure control. The control system may further be configured to receive commands from the remote operator and control fluid bleed or refill operations accordingly.

FIG. 1 is a diagram that illustrates well environment 100 in accordance with one or more embodiments. In the illustrated embodiment, well environment 100 includes reservoir ("reservoir") 102 located in subsurface formation ("formation") 104, and well system ("well") 106. Formation 104 may include a porous or fractured rock formation that resides underground, beneath the Earth's surface ("surface") 108. Reservoir 102 may be a hydrocarbon reservoir, and well 106 may be a hydrocarbon well, such as an oil well. In the case of the well 106 being a hydrocarbon well, reservoir 102 may be a hydrocarbon reservoir defined by a portion of formation 104 that contains (or that is determined contain to or expected to contain) a subsurface pool of hydrocarbons, such as oil and gas, that coexist with formation connate water. Formation 104 and reservoir 102 may each include different layers of rock having varying characteristics, such as varying degrees of lithology, permeability, porosity and fluid saturations. In the case of well 106 being operated as a production well, well 106 may facilitate the extraction of hydrocarbons (e.g., "production" of production fluid) from reservoir 102. In the case of well 106 being operated as an injection well, well 106 may facilitate the injection of substances, such as gas or water, into reservoir 102 (e.g., injection of injection fluid). In the case of well 106 being operated as a monitoring well, well 106 may facilitate the monitoring of various characteristics of formation 104 or reservoir 102, such as reservoir saturation or pressure.

Well 106 may include wellbore 120 and well control system 140. Well control system 140 may control various operations of well 106, such as well drilling operations, well completion operations, well production operations, well and formation monitoring operations, or well annulus pressure control and maintenance operations. In some embodiments, control logic of control system 140 may be implemented on a computer system that is the same as or similar to computer system 600 described with regard to at least FIG. 6. As shown in FIG. 1, well control system 140 may include annulus pressure control system 150 (e.g., well annulus breathing box, well annulus relief equipment, automated relief equipment, self-relief equipment, and the like). Annulus pressure control system 150 may include components and control logic to control and maintain pressure within an annulus (or multiple annuli) of well 106 within a predetermined pressure range (e.g., between a predetermined low annulus pressure value and a predetermined high annulus pressure value). Although FIG. 1 shows annulus pressure control system 150 as being included within well control system 140, certain components (e.g., sensors) of annulus pressure control system 150 may be provided or otherwise operate outside of well control system 140 and be communicatively coupled thereto. For example, some components of annulus pressure control system 150 may be provided downhole in the annulus (or annuli) of well 106.

Wellbore 120 (or "borehole") may include a bored hole that extends from surface 108 into a target zone of formation 104, such as reservoir 102. An upper end of wellbore 120, at or near surface 108, may be referred to as the "uphole" end of wellbore 120. A lower end of wellbore 120, terminating in formation 104, may be referred to as the "downhole" end of wellbore 120. Wellbore 120 may be created, for example, by a drill bit boring through formation 104 and reservoir 102. Wellbore 120 may provide for the circulation of drilling fluids during drilling operations, the flow of hydrocarbons (e.g., oil and gas; production fluid) from the reservoir 102 to the surface 108 during production operations, the injection of substances (e.g., water; injection fluid) into formation 104 or reservoir 102 during injection operations, or the communication of monitoring devices (e.g., logging tools) into the formation 104 or the reservoir 102 during monitoring operations (e.g., during shut-in or flow well logging operations). In some embodiments, wellbore 120 includes cased or uncased (or "open-hole") portions. A cased portion may include a portion of the wellbore 120 lined with casing (e.g., the up-hole end of the wellbore 120 may be lined with casing pipe and cement). An uncased portion may include a portion of the wellbore 120 that is not lined with casing (e.g., the open-hole, downhole end of the wellbore 120).

As shown in FIG. 1, wellbore 120 may be encased by outer casing 132 that separates and isolates wellbore 120 from surrounding formation 104 and reservoir 102 and associated subsurface materials (e.g., water, hydrocarbons, and the like). Within outer casing 132, inner casing 128 may form annular space 130 (e.g., casing-casing annulus (CCA), well annulus, and the like) between an outer surface of inner casing 128 and an inner surface of outer casing 132. Tubular 124, that defines tubular space 122, may be provided within inner casing 128 that creates annular space 126 (e.g., tubing-casing annulus (TCA), well annulus, and the like) between an outer surface of tubular 124 and an inner surface of inner casing 128. Although FIG. 1 shows wellbore 120 housing tubular 124 as being encased by outer casing 132 and inner casing 128, this is not intended to be limiting. Additional or fewer casings and/or tubulars may be included in wellbore 120, resulting in the formation of more or less well annular spaces (e.g., additional CCAs and/or TCAs). When well 106 is operated as a production well, production fluid may be passed up to the surface through tubular 124. Although FIG. 1 illustrates well 106 as being an onshore well, this may not necessarily be the case. In another embodiment, well 106 may be an offshore well with wellbore 120 penetrating the seabed to reach and extract production fluids from reservoir 102. In case well 106 is an offshore well, components of annulus pressure control system 150 (e.g., reservoir tank, piping, pump, and the like) may be provided on an offshore platform associated with and fluidly coupled to wellbore 120.

During the lifecycle of well 106 (e.g., during the drilling stage, the production stage, injection stage, monitoring stage, and the like), pressure in well annulus (e.g., pressure of fluid in one or both of TCA 126, CCA 130, and the like) may fluctuate due to a variety of factors. For example, during production, movement of fluid within wellbore 120 may result in a rise in temperature within wellbore 120, thereby causing pressure within well annulus 126 and/or 130 to increase. To handle the increase in pressure, tubular 124, inner casing 128, and/or outer casing 132 may be designed and selected so as to be able to withstand downhole pressure and temperature conditions of wellbore 120. However, despite the above, several problems exist with conventional techniques for handling annulus pressure.

Conventionally, to maintain and preserve well integrity, well operation and maintenance personnel may be required to conduct regular visits to well sites to perform annuli pressure surveys, bleed excess pressure (e.g., bleed production fluid, injection fluid, and the like) from the TCA and/or CCA, wait to observe annuli pressure build up, if any, refill bled volume back into the well annulus, if needed, and then move on to the next wellsite and repeat the steps for each well on a periodic or an aperiodic basis. High well annulus pressure may exert strain on various well components including the downhole packer, tubing, tubing hanger, and casing. Due to the large number of wells the operation and maintenance personnel may be required to attend to, many wells may have to wait for a long time for release of built up pressure in the well annulus. The long wait may get to the point where well integrity starts to get compromised (e.g., packer failure, casing crack/leak, tubing hanger leak or collapsed tubing due to excess pressure in the well annulus). Once well integrity is compromised, operating and maintenance personnel may be required to perform costly well workover operations to fix and regain well integrity. Thus, even if conventional wells may be designed to withstand high well annulus pressure, such conventional techniques may end up leaving the high well annulus pressure trapped for an extended period of time in the well annulus, thereby causing the well integrity loss. In other words, although well components are designed to withstand the pressure up to a certain limit of pressure value and time period, given the busy schedules of operators and the large number of remote wells they may have to attend to, many wells with conventional pressure control systems may reach the breaking point before human interaction can save them.

In order to overcome the above problems, as shown in FIG. 1, well environment 100 according to the present disclosure includes annulus pressure control system 150 that is configured to automatically control and maintain well annulus pressure (e.g., bleed and refill fluid in well annulus) within predetermined limits, without the need for manual intervention. By implementing annulus pressure control system 150, life of well 106 may be extended, and costly workover operations to fix and regain well integrity may be avoided or minimized. Additionally, annulus pressure control system 150 may provide benefits in terms of reduced costs associated with well operation and maintenance personnel having to conduct visits to wellsite 106 which may be at remote and distant locations.

Figure 2:
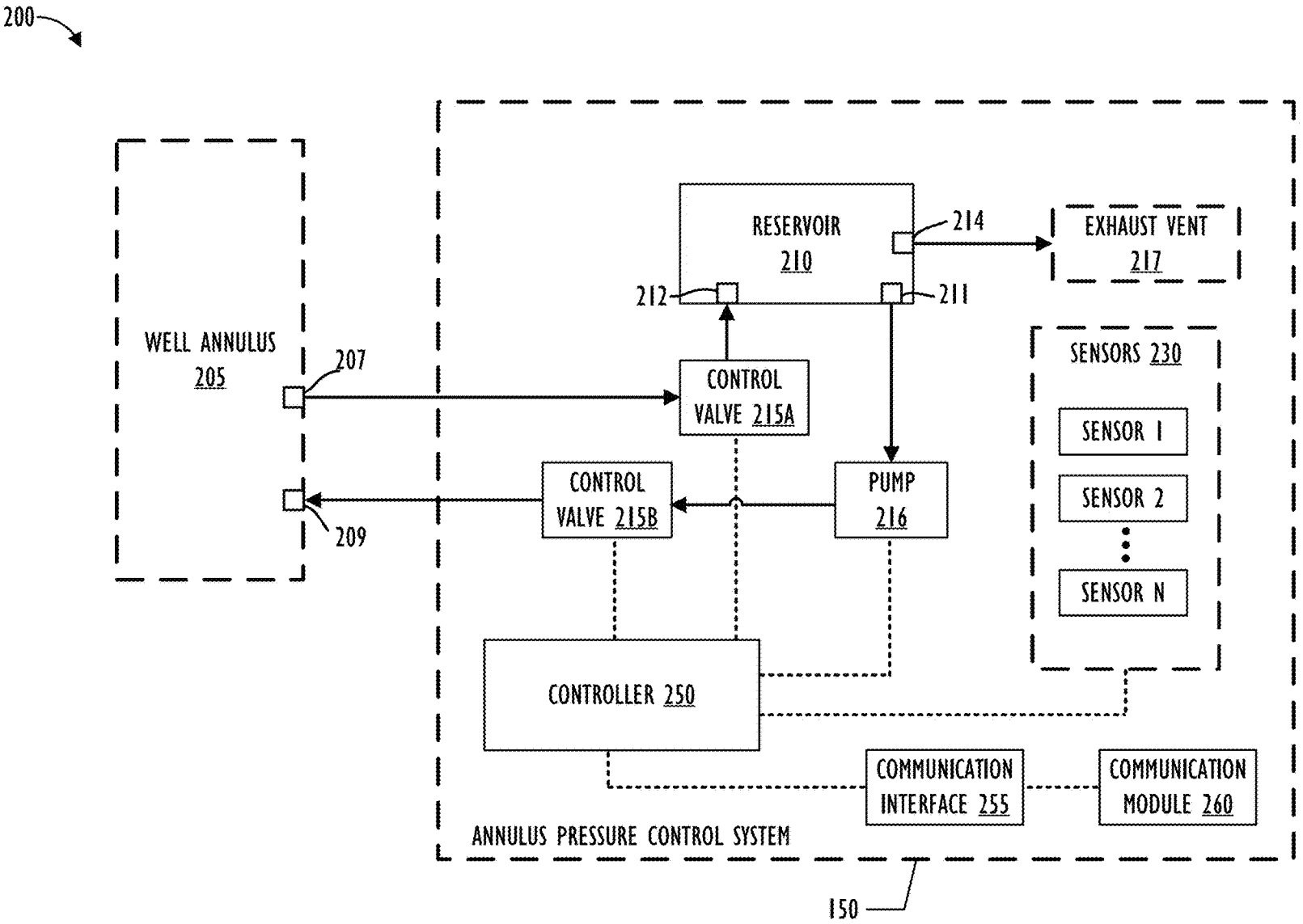
FIG. 2 is a block diagram of an annulus pressure control system in accordance with one or more embodiments.

FIG. 2 shows block diagram 200 of annulus pressure control system 150 (e.g., well annulus breathing box) in accordance with one or more embodiments. Annulus pressure control system 150 according to the present disclosure can be installed 'rig-less' on an existing well or a new well currently undergoing drilling. As shown in FIG. 2, annulus pressure control system 150 in fluidly coupled via one or more outlet and inlet ports 207 and 209 to well annulus 205 to bleed excess fluid (e.g., production fluid, drilling fluid, injection fluid, gas, vapor, and the like) from well annulus 205 into reservoir 210 of annulus pressure control system 150 and/or to supply the fluid stored in reservoir 210 back into well annulus 205. Well annulus 205 may correspond to any annular space within well 106. For example, outlet and inlet ports 207 and 209 may fluidly couple annulus pressure control system 150 with one or both of TCA 126 and CCA 130 of well 106 of FIG. 1. As another example, one instance of annulus pressure control system 150 may be fluidly coupled via first set of outlet and inlet ports 207 and 209 to a first well annulus (e.g., TCA 126), and the same instance or another instance of annulus pressure control system 150 may be fluidly coupled via second set of outlet and inlet ports 207 and 209 to a second well annulus (e.g., CCA 130), and so on. Annulus pressure control system 150 may then separately and independently control pressure within the different well annuli (e.g., TCA 126, CCA 130, and the like) so as to maintain respective detected well annulus pressure within corresponding predetermined operating levels. In some embodiments, annulus pressure control system 150 may be configured to collectively control pressure within multiple well annuli (e.g., TCA 126, CCA 130, and the like) of well 106 so as to maintain well annulus pressure of each well annulus within a predefined permissible range.

As shown in FIG. 2, annulus pressure control system 150 includes reservoir 210, one or more control valves 215, one or more pumps 216, exhaust vent, one or more sensors 230, controller 250, communication interface 255, and communication module 260. In general, annulus pressure control system 150 provides automated self-relief of high well annulus pressure and refill in case of low well annulus pressure by using relief equipment connected to a wellhead port (e.g., outlet and inlet ports 207 and 209 of well annulus). As mentioned previously, one or more components of annulus pressure control system 150 may be provided at different locations of well environment 100 and communicatively coupled with each other. For example, reservoir 210 may be provided on at a location on surface 108 that is proximate to borehole 120. In case well 106 is an offshore well, reservoir 210 may be provided on an offshore platform associated with borehole 120. Further, at least some of the sensors 230 may be provided downhole in the well annulus (e.g., TCA 126, CCA 130, and the like) 205, in tubular space 122 associated with borehole 120, and communicatively coupled to controller 250.

Reservoir 210 may be a storage tank, tanker truck, open pit, or any other receptacle or storage chamber that may be at atmospheric pressure and has sufficient storage capacity for the volume of fluid bled from well annulus 205. Reservoir 210 may include first outlet port 211, and inlet port 212. First outlet port 211 and inlet port 212 may be fluidly coupled to well annulus 205 via respective inlet and outlet ports 209 and 207. In case reservoir 210 is implemented as a large tank or storage chamber, reservoir 210 may include second outlet port 214 to vent vaporized fluid or gas from reservoir 210 into the ambient atmosphere by feeding the vaporized fluid or gas to exhaust vent 217 via second outlet port 214 and one or more exhaust pipes.

Annulus pressure control system 150 may include a pipe that fluidly couples outlet port 207 of well annulus 205 to inlet port 212 of reservoir 210 via control valve 215A. Control valve 215A may be a one-way valve (e.g., first control valve, relief valve, check valve, clack valve, non-return valve, reflux valve, retention valve and the like) that normally allows fluid to flow through it in only one direction—from well annulus 205 to reservoir 210. Annulus pressure control system 150 may further include another pipe that fluidly couples inlet port 209 of well annulus 205 to first outlet port 211 of reservoir 210 via pump 216 and control valve 215B. Control valve 215B may also be a one-way valve (e.g., second control valve, relief valve, check valve, clack valve, non-return valve, reflux valve, retention valve and the like) that normally allows fluid to flow through it in only one direction—from reservoir 210 to well annulus 205. Valves 215 may be equipped with flowmeters that measure the fluid volumes flowing therethrough and that output measured volume data for logging and recording by controller 250.

In one embodiment, inlet port 209 and outlet port 207 may be the same port fluidly coupled to well annulus 205. The pipe of annulus pressure control system 150 to fluidly couple well annulus 205 to reservoir 210 may be a pipe (e.g., third fluid coupling) that is coupled to the same port 207/209 of well annulus 205 at the upstream end and that splits into two elbows, with each elbow connected to reservoir 210 via corresponding a one-way valve 215. That is, one elbow (e.g., first fluid coupling) may be connected to control valve 215A and another elbow (e.g., second fluid coupling) connected to control valve 215B. Pump 216 may be any type of mechanical device or prime mover (e.g., direct lift pump, displacement pump, gravity pump, submersible pump, prime mover, and the like) to move fluid stored in reservoir 210 back into well annulus 205. In the embodiment shown in FIG. 2, pump 216 is disposed between first outlet port 211 of reservoir 210 and control valve 215B. However, this may not necessarily be the case. Pump 216 may be disposed at any point on the fluid coupling between first outlet port 211 and inlet port 209, so long as pump 216 may facilitate controlled movement of fluid stored in reservoir 210 back into well annulus 205. In addition, although not shown in FIG. 1, a pump or prime mover may also be provided on the fluid coupling between outlet port 207 and inlet port 212 to facilitate controlled movement of fluid from well annulus 205 into reservoir 210.

Sensors 230 (e.g., Sensor 1, Sensor 2, . . . Sensor N) may include one or more of a plurality of types of sensors. For example, sensors 230 may include an optical, light or imaging sensor, a flow or fluid velocity sensor (e.g., flow sensor, flowmeter, and the like), an environment or weather sensor, a humidity sensor, a thermal, heat or temperature sensor, a position, angle, displacement, distance, or speed sensor (e.g., laser rangefinder and the like), an optical activity sensor, an optical sensor array, a barometric sensor, a vibration sensor, a barometer, a magnetometer, a thermistor sensor, an electrostatic sensor, a differential light sensor, an opacity sensor, a scattering light sensor, a diffractional sensor, a refraction sensor, a reflection sensor, a velocity sensor, a momentum sensor, a wave radar probe, a pressure gauge, and the like. The type of sensor is not intended to be limiting and any sensor type can be used so as to enable functionality of annulus pressure control system 150 as described herein.

Sensors 230 may be disposed at different locations of annulus pressure control system 150 or well environment 100, and may be configured to detect (e.g., sense) a different types of sensor data. For example, sensors 230 may include sensors disposed downhole in well annulus 205 to detect pressure and/or temperature in well annulus 205 (e.g., fluid pressure within or at one or more points or regions of TCA 126, pressure within or at one or more points or regions of CCA 130, and the like), sensors disposed downhole in tubular space 122 to detect pressure and/or temperature within or at one or more points or regions of tubular space 122, sensors disposed uphole at inlet and outlet ports 209 and 207 to detect pressure and/or temperature at the wellhead, and the like. Further, sensors 230 may include sensors disposed along one or more of the fluid couplings between well annulus 205 and reservoir 210 to detect sensor data indicating an amount of fluid flowing out of well annulus 205 and into reservoir 210 via control valve 215A and/or fluid temperature or composition thereof, sensor data indicating an amount of fluid flowing back into well annulus 205 and from reservoir 210 via control valve 215B and pump 216 and/or fluid temperature or composition thereof, and the like. Still further, sensors 230 may include one or more sensors to detect sensor data indicating the current fluid level stored in reservoir 210, one or more sensors to detect ambient environment conditions associated with well environment 100, one or more sensors to detect whether well integrity has been compromised (e.g., uphole or downhole sensors to detect packer failure, casing crack/leak, tubing hanger leak, or collapsed tubing due to excess pressure well annulus, etc.) and the like. Controller 250 of annulus pressure control system 150 may be configured to receive sensor data from sensors 230. The number, type, position, location, angle, and other characteristics of sensors 230 are not intended to be limiting, and may be determined so that annulus pressure control system 150 can effectively control and maintain annulus pressure within set permissible operating limits to preserve well integrity.

Controller 250 may be communicatively coupled to control valves 215A and 215B, pump 216, sensors 230, and communication interface 255. Controller 250 may be configured to operate control valves 215A and 215B, and pump 216, based on sensor data from one or more of sensors 230, and regulate flow of fluid from well annulus 205 to reservoir 210, or vice versa, so as to maintain pressure within well annulus 205 within predetermined operating ranges. Controller 250 may include a computer system that is the same as or similar to computer system 600 described with regard to at least FIG. 6. Controller 250 may also be configured to record (e.g., log) data indicating the behavior of the well, corresponding sensor data, and corresponding automated operations for self-relief/refill of fluid from/to well annulus 205 performed by controller 250 based on the sensor data 230 and predetermined control logic.

Controller 250 may further be configured to transmit this data (e.g., log data, error handling data) to a remote operator via communication interface 255 and communication module 260. For example, communication module 260 may be a satellite based communication module, internet-based communication module, telecommunications-network-based communication module, and the like. Controller 250 may also control communication module 260 to transmit a notification to an operator regarding an error condition associated with the well when, e.g., annulus pressure control system 150 is unable to bring well annulus pressure within the normal operating range despite performing appropriate automated well annulus fluid self-relief/refill operations. Annulus pressure control system 150 may thus enable the remote operator to monitor and view a live feed of the behavior of the well, and manually intervene and remotely control annulus pressure by issuing commands for manual fluid release or refill operations. Annulus pressure control system 150 may further enable the remote operator to change, based on the live feed of the behavior of the well, the preset pressure and time triggers associated with the control logic, if a certail well is noted to start different flowing regimes/behaviors. Operation and control logic of controller 250 for maintaining pressure within well annulus 205 is described in connection with FIGS. 3-5 below.

Figure 3:
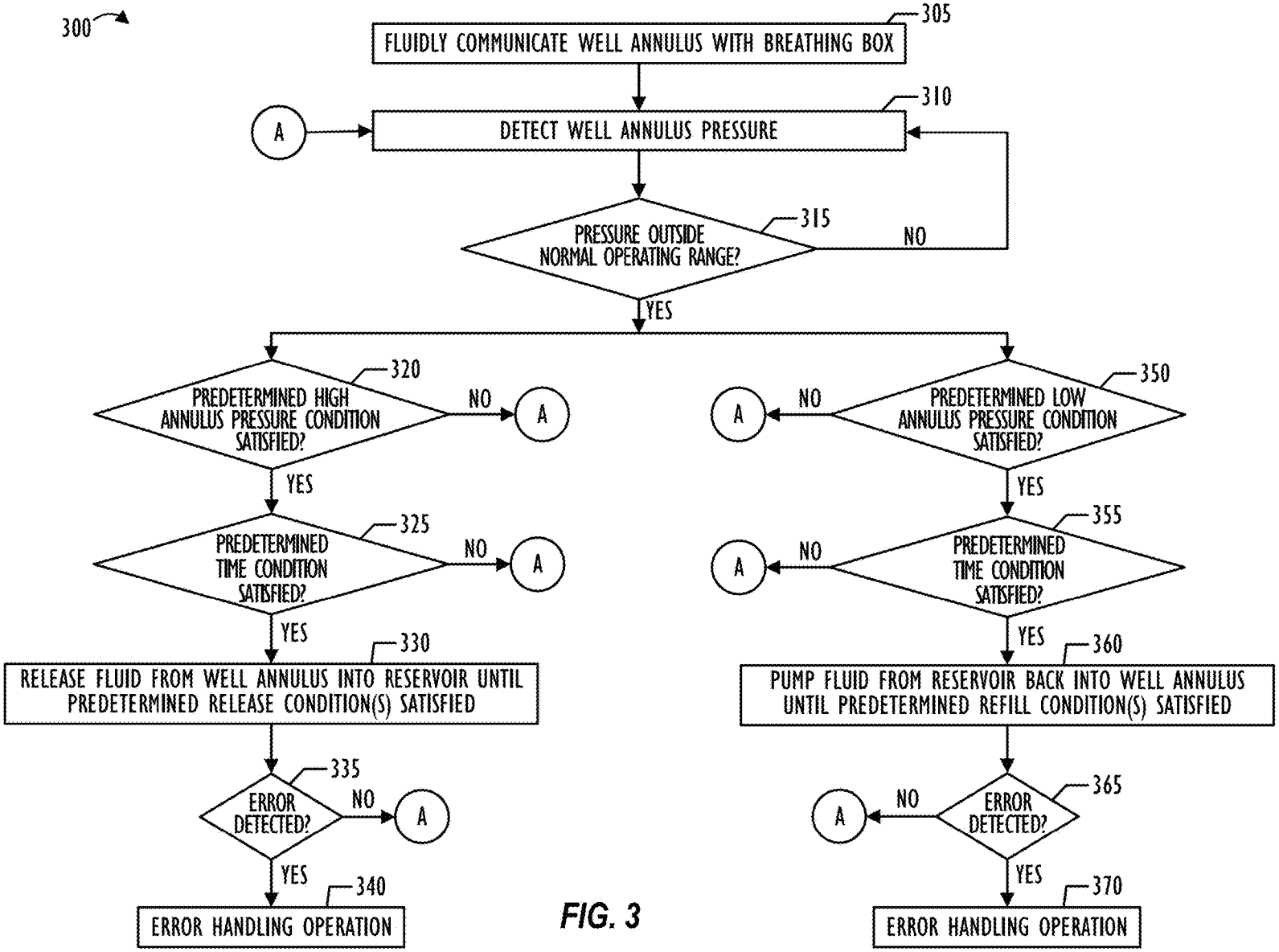
FIG. 3 is a flow chart that illustrates a method for automatically controlling annulus pressure by the annulus pressure control system, in accordance with one or more embodiments.

FIG. 3 is a flow chart that illustrates method 300 for automatically controlling annulus pressure by the annulus pressure control system, in accordance with one or more embodiments. Method 300 starts at block 305 where the well annulus (e.g., well annulus 205 of FIG. 2, TCA 126 of FIG. 1, CCA 130 of FIG. 1, and the like) is fluidly communicated with the annulus pressure breathing box (e.g., annulus pressure control system 150 of FIG. 2). For example, as mentioned previously, automated self-relief equipment in the form of the annulus pressure control system may be fluidly connected to the wellhead port of the well annulus. Operating personnel may install and fluidly couple the annulus pressure control system (breathing box) at the wellhead for an existing or newly drilled well so as to automatically maintain well annulus pressure and enable remote monitoring of annulus pressure conditions of the well. Method 300 may then move to block 310, where the controller (e.g., controller 250 of FIG. 2) of the annulus pressure control system controls one or more sensors to detect pressure within the well annulus (e.g., pressure in one or more tubing-casing annuli, pressure in one or more casing-casing annuli, a combination of pressure in one or more tubing-casing annuli and casing-casing annuli, and the like). As explained previously, one or more pressure sensors may be disposed within the well annulus and the controller of the well annulus pressure control system may control the one or more pressure sensors to detect the current pressure acting on the fluid that is in the well annulus. In one embodiment, the controller may control the sensors to automatically detect pressure in the well annulus on a periodic or an aperiodic basis. In another embodiment, the controller may control the sensor to detect the pressure based on a user operation or in response to a trigger condition (e.g., change in production volume).

At block 315, the controller may determine whether the detected pressure in the well annulus is outside a normal operating range. In one embodiment, the normal operating range may be a predetermined range that is selectively set by a user (e.g., remote operator) and that is configurable based on a user operation. The predetermined range may depend on the current operational state of the well. That is, the user may selectively set a first range that is "normal" when the well is in a first state (e.g., well is actively producing hydrocarbons), and the user may selectively set a second range that is "normal" when the well is in an second state (e.g., when the well is in a "dead" or "shut-in" state). As another example, different ranges may be pre-defined, and at block 315, the controller may compare the detected well annulus pressure against a particular defined pressure range that corresponds to the current operation stage of the well (e.g., drilling stage, production stage, injection stage, monitoring stage, shut-in stage, and the like). As yet another example, the normal pressure range for the well annulus may vary depending on the current flowing wellhead pressure. That is, the acceptable high and low pressure values of the well annulus pressure range may vary depending on the current pressure inside the production tubing (e.g., tubular 124 of FIG. 1) of the wellbore.

By way of a concrete example, for active wells that are in a producing state, normal high TCA (or other annulus) pressure may be set to be approximately 200 psi over the flowing wellhead pressure (e.g., pressure in tubular space 122 of FIG. 1), and the normal low TCA (or other annulus) pressure may be set to be equal to (but not be lower than) the flowing wellhead pressure inside the production tubing. Thus, if the pressure inside the production tubing of an active well in a producing state is 300 psi, the normal pressure range for the well annulus of such a well in its current state may be set at 300 psi-500 psi. As another example, for a well that is "dead" or "shut-in", the normal low TCA (or other annulus) pressure may be defined as a minimum of 200 psi (i.e., annulus pressure should not be lower than 200 psi) regardless of the wellhead pressure inside the production tubing, and the normal high TCA (or other annulus) pressure may be defined as not more than approximately 200 psi to 400 psi over the wellhead pressure inside the production tubing. Thus, in this case, if the pressure inside the production tubing of the "dead" well is 15 psi (i.e., approximately at atmospheric pressure), the normal pressure range for the well annulus such a well in its current state may be set at 200 psi-215 psi, and it should not read zero.

If it is determined at block 315 that the detected pressure in the well annulus is not outside the normal operating range (NO at block 315), the controller of the pressure control system determines that the annulus pressure is "normal" for the current state of the well and no pressure control operation needs to be performed. And in this case, the controller proceeds to periodically (or aperiodically or in response to a user operation) check the well annulus pressure at block 310. If, on the other hand, the controller determines at block 315 that the detected pressure in the well annulus is outside the normal operating range (YES at block 315), the controller of the pressure control system determines that the annulus pressure is not "normal" and operation proceeds to one of block 320 and block 350 based on whether the detected annulus pressure is higher than the normal operating range (block 320) or lower than the normal operating range (block 350).

In response to determining that the current well annulus pressure detected at block 310 is higher than the normal operating range, operation moves to block 320 where the controller further determines whether a predetermined high annulus pressure condition is satisfied. The predetermined high annulus condition may be selectively set by a user. Continuing the above example of an active well that is in a producing state, the predetermined high annulus pressure condition at block 320 may be determined to be satisfied if a pressure value of the well annulus pressure (e.g., TCA pressure) goes approximately 600 psi over the wellhead pressure. Thus, in case the pressure inside the production tubing is 300 psi and the normal pressure range is set at 300 psi-500 psi, the predetermined high annulus pressure condition at block 320 may be determined to be satisfied if the well annulus pressure (e.g., TCA pressure) goes higher than 900 psi. As another example, in case the pressure inside the production tubing of a "dead" well is 15 psi and the normal pressure range is set at 200 psi-215 psi, the predetermined high annulus pressure condition at block 320 may be determined to be satisfied if the well annulus pressure (e.g., TCA pressure) goes higher than 615 psi.

If the controller determines that the predetermined high annulus pressure condition is satisfied (YES at block 320), operation proceeds to block 325 where the controller further determines whether a predetermined time condition is satisfied. The predetermined time condition may be selectively set by a user. For example, at block 325, the controller may determine whether the high annulus pressure condition of block 320 is maintained (i.e., remains true) for a predetermined period of time (e.g., 3 days). Continuing the above example, at block 325, the controller may determine the predetermined time condition to be satisfied if the well annulus pressure (e.g., TCA pressure) remains higher than 900 psi for more than the predetermined period of time (e.g., 3 days). At block 325, the controller may be configured to determine that the predetermined time condition is satisfied if the high annulus pressure condition remains true for an entire period corresponding to the predetermined time condition (e.g., annulus pressure remains more than 900 psi continuously and uninterruptedly for the full 3-day period). Alternately, at block 325, the controller may be configured to determine that the predetermined time condition is satisfied if the high annulus pressure condition remains true for a portion of the time period corresponding to the predetermined time condition (e.g., condition at block 325 determined to be satisfied even if annulus pressure falls below the 900 psi cut-off during the 3-day period so long as threshold time and pressure requirements are met). As yet another example, the controller may be configured to determine that the predetermined time condition is satisfied at block 325 if the detected annulus pressure goes significantly beyond the cut-off specified by the high annulus pressure condition (e.g., condition at block 325 determined to be satisfied if annulus pressure goes significantly beyond the 900 psi cut-off even if the 3-day time requirement is not met).

In response to determining that the predetermined time condition is satisfied (YES at block 325), operation proceeds to block 330 where the controller operates control valve 215A to release pressurized fluid from the well annulus into the reservoir tank. In one embodiment, the controller may continue to release fluid from the well annulus into the reservoir tank at block 330 until one or more predetermined release conditions are met. For example, the controller may be configured to release the pressurized fluid from the well annulus into the reservoir until the detected well annulus pressure falls below a threshold pressure value (e.g., predetermined release condition). Continuing the above example for an active well that is in a producing state whose normal operating range is 300 psi-500 psi, the controller may continue to release the fluid from the well annulus by operating control valve 215A until the detected annulus pressure falls below 500 psi. Alternately, the controller may be configured to continue to release the fluid from the well annulus by operating control valve 215A until the detected annulus pressure falls below a value that is higher than the normal operating range but lower than the high pressure value defined by the high annulus pressure condition (e.g., a threshold value between 500 psi and 900 psi in the above example). At block 330, regardless of whether the detected pressure has fallen down to a sufficient level, the controller may be further configured to control (e.g., reduce or stop) release of fluid from the well annulus into the reservoir based on detection of an error condition. For example, the controller may detect the error condition based on a fluid relief volume limit (e.g., the volume or amount of fluid that has been released from the well annulus), a reservoir storage limit (e.g., the current storage level of fluid in the reservoir), and a time limit (e.g., amount of elapsed time since release of fluid at block 330 started). At block 330, the controller may further notify a remote operator of the (recently completed or currently ongoing) fluid release operation, and transmit corresponding data like real-time sensor data, and data regarding well behavior, fluid volume released, pressure in well annulus, pressure in production tubing, and the like.

At block 335, if any of the limits being monitored by the controller are reached, the controller may detect an error condition (YES at block 335) and perform an error handling operation (block 340) based on the detected error condition. For example, if a predetermined time limit or relief volume limit is exceeded while releasing the fluid from the well annulus to the reservoir, the controller may be configured to automatically shut off relief valve 215A to stop release of fluid from the well annulus regardless of whether the well annulus pressure is now within the normal operating range or whether the pressure is now below the threshold value. In one embodiment, the error handling operation performed by the controller at block 340 may comprise the controller issuing a notification or error message to an operator to attend to and troubleshoot the well with the annulus pressure buildup that won't bleed even after operating the annulus pressure control system.

If the controller determines that the predetermined high annulus pressure condition is not satisfied (NO at block 320), or if the controller determines that the predetermined time condition is not satisfied (NO at block 325), or if the controller does not detect any error condition at block 335 (NO at block 335), operation proceeds to block 310 where the current well annulus pressure is detected again.

Figure 4:
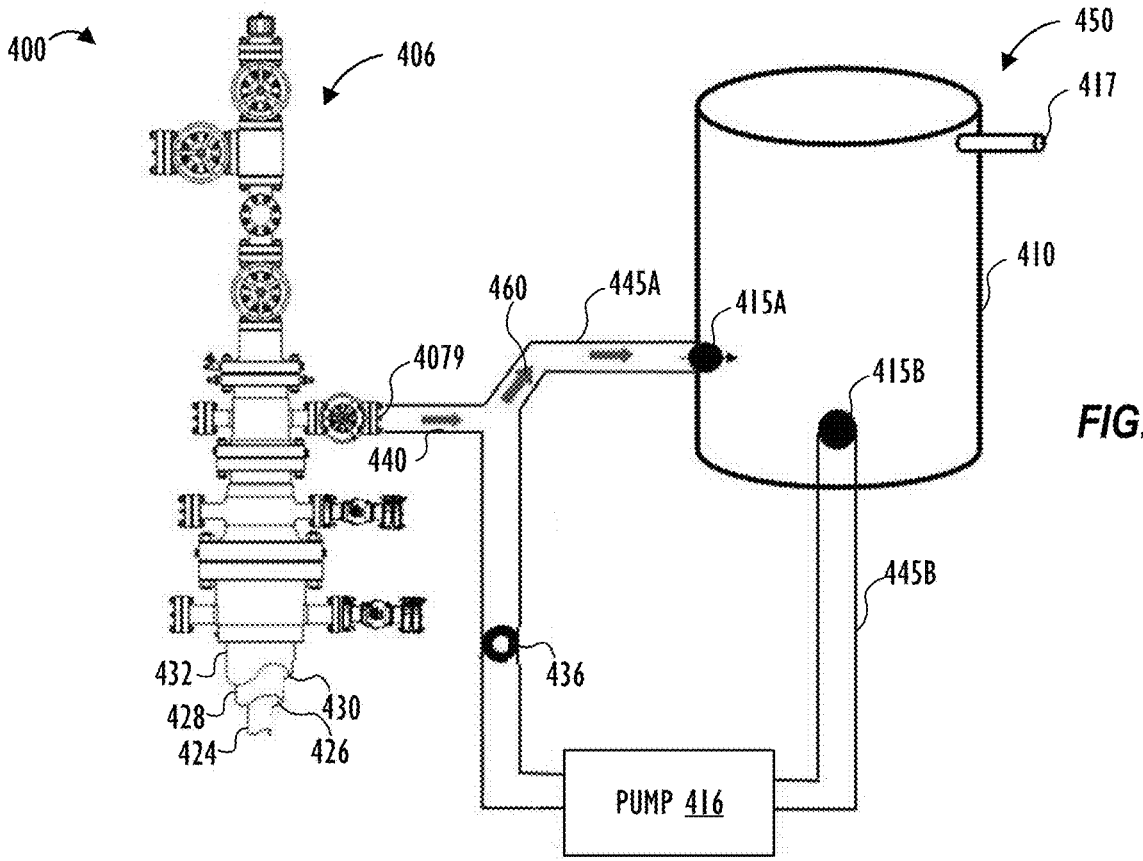
FIG. 4 is a diagram that illustrates automated pressure release from the annulus to an external reservoir by the annulus pressure control system, in accordance with one or more embodiments.

Operations performed at blocks 320-340 of method 300 are explained in further detail in connection with FIG. 4. FIG. 4 is a diagram of wellsite 400 that illustrates automated pressure release from the well annulus (e.g., 426 and/or 430) to external reservoir 410 by annulus pressure control system 450, in accordance with one or more embodiments. As shown in FIG. 4, wellsite 400 may include well system 406 and well annulus pressure control system 450. Well system 406 may include outer casing 432 that separates and isolates a wellbore corresponding to well system 406 from surrounding geological formations and associated subsurface materials (e.g., water, etc). Within outer casing 432, inner casing 428 may form annular space 430 (e.g., casing-casing annulus (CCA), well annulus, and the like) between an outer surface of inner casing 428 and an inner surface of outer casing 432. Tubular 424 may be provided within inner casing 428 that creates annular space 426 (e.g., tubing-casing annulus (TCA), well annulus, and the like) between an outer surface of tubular 424 and an inner surface of inner casing 428. Annulus pressure control system 450 (e.g., well annulus breathing box) may be fluidly coupled via inlet/outlet port 4079 to the well annulus (e.g., TCA 426 and/or CCA 430) to bleed excess fluid from the well annulus into reservoir 410 and/or to supply the fluid stored in reservoir 410 back into the well annulus. Pipe 440 of annulus pressure control system 450 may be fluidly coupled to inlet/outlet port 4079 at the upstream end and split into two elbows 445A and 445B, with each elbow connected to reservoir 410 via corresponding one-way valves 415A and 415B. Sensor 436 (e.g., flowmeter) and pump 416 and may disposed on elbow pipe 445B that fluidly couples inlet/outlet port 4079 and one-way valve 415B. Reservoir 410 may include exhaust vent 417 to vent exhaust gas.

During operation, the controller may detect (using a sensor) and record pressure in the well annulus (426, 430) as the well annulus pressure starts to build up. Once the pressure reaches a preset cut off pressure (e.g., predetermined high annulus pressure condition satisfied (e.g., 900 psi)), the controller may cause a timer to start running and count down to a preset value (e.g., predetermined time period (e.g., 3 days)). While the timer is running, if the controller determines that the pressure in the well annulus as gone below the cut-off (e.g., pressure goes below 900 psi before end of the 3-day period), the controller determines that no pressure release or bleed operation needs to be performed. But if the controller determines that that high pressure condition continues and the time limit is reached, the controller may automatically open the one-way valve 415A to bleed off excess well annulus pressure into reservoir 410 as shown by arrows 460. The bleed may feed into tank 410 which may store the well annulus fluid and may release gases, if any, via vent 417. The controller may continue this bleed-off until the detected pressure in the well annulus falls below a preset threshold value (e.g., 700 psi) that is lower than the predetermined high annulus pressure condition value and equal to or higher than normal operating range. However, if the detected pressure does not fall below the preset threshold value even after a predetermined relief fluid volume limit, a tank storage limit, or a time limit has been reached, the controller may determine the presence of an error condition (e.g., well suspected to possibly have either an leak through the packer, casing, or tubing which is causing the continuous pressure build up in the well annulus) and shut off the one-way valve 415A regardless of the well annulus pressure build up. The controller may then notify an operator via any appropriate communication modality (e.g., internet, telecommunication network, satellite network, and the like) to attend and troubleshoot the error condition. For example, annulus pressure control system 450 may include a data storing chip (e.g., implemented via controller 250, computer system 600, and the like) disposed on reservoir 410, powered by a solar panel, and connected to a satellite to allow a remote operator to view well behavior and access sensor data (e.g., a log of well annulus fluid release and/or refill operations automatically performed by annulus pressure control system 450), and manually troubleshoot the error condition.

Returning to FIG. 3, in response to determining that the current well annulus pressure detected at block 310 is lower than the normal operating range, operation moves to block 350 where the controller further determines whether a predetermined low annulus pressure condition is satisfied. The predetermined low annulus condition may be selectively set by a user. Continuing the above example of an active well that is in a producing state, the predetermined low annulus pressure condition at block 350 may be determined to be satisfied if a pressure value of the well annulus pressure (e.g., TCA pressure) goes below the wellhead pressure. Thus, in case the pressure inside the production tubing of an active well in a producing state is 300 psi and the normal operating range is 300 psi-500 psi, the predetermined low annulus pressure condition at block 350 may be determined to be satisfied if the well annulus pressure (e.g., TCA pressure) goes below 300 psi. As another example, in case the pressure inside the production tubing of a "dead" well is 15 psi, since the minimum well annulus pressure (e.g., TCA pressure) may be set at 200 psi, the predetermined low annulus pressure condition at block 350 may be determined to be satisfied if the well annulus pressure (e.g., TCA pressure) goes below 200 psi.

If the controller determines that the predetermined low annulus pressure condition is satisfied (YES at block 350), operation proceeds to block 355 where the controller further determines whether a predetermined time condition is satisfied. The predetermined time condition may be selectively set by a user. For example, at block 355, the controller may determine whether the low annulus pressure condition of block 350 remains true for a predetermined period of time (e.g., 3 days). Continuing the above example for an active well, at block 355, the controller may determine the predetermined time condition to be satisfied if the well annulus pressure (e.g., TCA pressure) remains lower than 300 psi (or current wellhead pressure inside production tubing) for more than the predetermined period of time (e.g., 3 days). At block 355, the controller may be configured to determine that the predetermined time condition is satisfied if the low annulus pressure condition remains true for an entire period corresponding to the predetermined time condition (e.g., condition determined to be satisfied if annulus pressure remains lower than 300 psi continuously and uninterruptedly for the full 3-day period). Alternately, at block 355, the controller may be configured to determine that the predetermined time condition is satisfied if the low annulus pressure condition remains true for a portion of the time period corresponding to the predetermined time condition (e.g., condition determined to be satisfied even if annulus pressure goes above the 300 psi cut-off one or more times during the 3-day period so long as threshold low pressure conditions are met). As yet another example, the controller may be configured to determine that the predetermined time condition is satisfied at block 355 if the detected annulus pressure goes significantly below the cut-off specified by the low annulus pressure condition (e.g., condition at block 355 determined to be satisfied if annulus pressure goes significantly below the 300 psi cut-off even if the 3-day time requirement is not met).

In response to determining that the predetermined time condition is satisfied (YES at block 355), operation proceeds to block 360 where the controller controls pump 216 and control valve 215B to pump fluid (e.g., production fluid, diesel, etc.) from the reservoir tank back into the well annulus. In one embodiment, the controller may continue to pump fluid from the reservoir tank back into the well annulus at block 360 until one or more predetermined refill conditions are satisfied. For example, the controller may be configured to pump the fluid from the reservoir tank into the well annulus until the detected well annulus pressure goes above a threshold pressure value (e.g., predetermined refill condition). Continuing the above example for an active well that is in a producing state whose normal operating range is 300 psi-500 psi, the controller may continue to pump the fluid into the well annulus by operating control valve 215B and pump 216 until the detected annulus pressure climbs up to 300 psi. Alternately, the controller may be configured to continue to pump the fluid into the well annulus from the tank until the detected annulus pressure climbs up to a value that is higher than the minimum annulus pressure value (e.g., 200 psi). At block 360, regardless of whether the detected pressure has climbed up to a sufficient level (e.g., threshold value), the controller may be further configured to control (e.g., reduce or stop) pumping of the fluid from the reservoir tank back into the well annulus based on detection of an error condition. For example, the controller may detect the error condition based on a pumping limit (e.g., the volume or amount of fluid that has been pumped into the well annulus), a reservoir storage limit (e.g., the current storage level of fluid in the reservoir), and a time limit (e.g., amount of time since pumping of fluid at block 360 started). At block 360, the controller may further notify a remote operator of the (recently completed or currently ongoing) fluid refill or pumping operation, and transmit corresponding data like real-time sensor data, and data regarding well behavior, fluid volume pumped into well annulus, pressure in well annulus, pressure in production tubing, fluid level in reservoir tank, and the like.

At block 365, if any of the limits being monitored by the controller are reached, the controller may detect an error condition (YES at block 365) and perform an error handling operation (block 370) based on the detected error condition. For example, if a predetermined time limit or pumping limit is exceeded while pumping the fluid from the reservoir tank into the well annulus, the controller may be configured to automatically shut off pump 216 and one-way valve 215B to stop pumping of fluid from the reservoir into the well annulus regardless of whether the well annulus pressure has climbed up to now be within the normal operating range or otherwise higher than the set threshold value. In one embodiment, the error handling operation performed at block 370 may comprise the controller issuing a notification or error message to an operator to attend to and troubleshoot the well with the low annulus pressure that won't climb up even after operating the annulus pressure control system to pump fluid back into the annulus.

Figure 5:
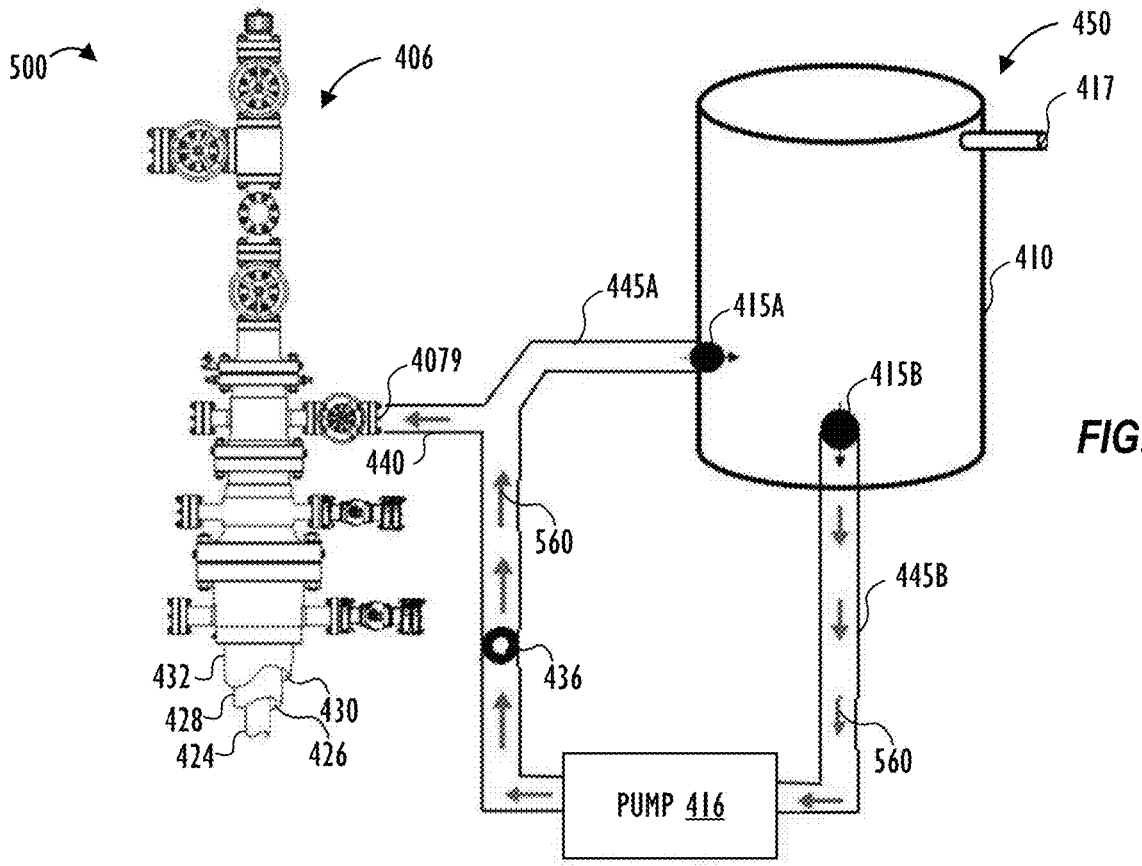
FIG. 5 is a diagram that illustrates automated pressure refill from the external reservoir back into the annulus by the annulus pressure control system, in accordance with one or more embodiments.

If the controller determines that the predetermined low annulus pressure condition is not satisfied (NO at block 350), or if the controller determines that the predetermined time condition is not satisfied (NO at block 355), or if the controller does not detect any error condition at block 365 (NO at block 365), operation proceeds to block 310 where current well annulus pressure is detected again. Operations performed at blocks 350-370 of method 300 are explained in further detail in connection with FIG. 5. FIG. 5 is a diagram of wellsite 500 that illustrates automated pressure refill from reservoir 410 back into the well annulus by annulus pressure control system 450, in accordance with one or more embodiments. Elements in FIG. 5 that are generally the same as those in FIG. 4 are denoted by like reference numerals and the description thereof will be omitted to avoid duplication.

During operation, the controller may detect (using a sensor) and record pressure in the well annulus (426, 430) as the well annulus pressure starts to drop. For example, behavior of the well may change over time, or a well shut down may cause the well's temperature to drop, which may cause the well annulus pressure to drop, possibly to a value that is below an acceptable level of well annulus pressure. In this case, it may be necessary to pump fluid back into the well annulus to maintain a minimum threshold pressure. Once the pressure drops below a preset cut off pressure or minimal value (e.g., predetermined low annulus pressure condition satisfied (e.g., 200 psi)), the controller may cause a timer to start running and count down to a preset time value (e.g., predetermined time period (e.g., 3 days)). While the timer is running, if the controller determines that the pressure in the well annulus as risen above the cut-off (e.g., pressure goes above 200 psi before end of the 3-day period)), the controller determines that no refill or pumping operation needs to be performed. But if the controller determines that that low pressure condition continues and the time limit is reached, the controller may automatically open the one-way valve 415B and automatically operate pump 416 to refill fluid from reservoir 410 back into the annulus as shown by arrows 560 in FIG. 5. Thus, pump 416 may automatically start to suck fluid from tank 410 and pump it into well annulus (e.g., TCA 426) until the desired pressure is achieved in the well annulus. Flowmeter 436 provided on the fluid path between one-way valve 415B and the well annulus may measure the volume pumped back in to keep a record.

The controller may continue this refill operation until the detected pressure in the well annulus rises above a preset value (e.g., minimum annulus pressure value of 200 psi, a value equal to the wellhead pressure in the production tubing, and the like). However, if the detected pressure does not climb up to the preset value even after reaching a predetermined pumping limit, storage limit or time limit, the controller may determine the presence of an error condition (e.g., well suspected to possibly have a leak where all the refilled annular fluid is going downhole) and shut off the one-way valve 415B and stop pump 416 regardless of the low well annulus pressure. The controller may then notify an operator via any appropriate communication modality (e.g., internet, telecommunication network, satellite network, and the like) to attend and troubleshoot the error condition. For example, annulus pressure control system 450 may include a data storing chip (e.g., implemented via controller 250, computer system 600, and the like) disposed on reservoir 410, powered by a solar panel, and connected to a satellite to allow a remote operator to view well behavior and access sensor data (e.g., a log of well annulus fluid release and/or refill operations automatically performed by annulus pressure control system 450), and manually troubleshoot the error condition.

The well annulus breathing box (annulus pressure control system) thus provides a mechanism for allowing the well to "temporarily breathe" as it goes under heating and cooling periods, both of which can cause damage to well components and thereby compromise well integrity. The well annulus breathing box thus enables reduced human interaction/error, reduced surveillance while improving surveillance quality, and maintains well integrity for an extended period of time compared to conventional techniques. In addition, the breathing box provides a mechanism to ensure quicker response times to wells that are in need of maintenance by receiving automatic notifications of error conditions remotely, and saves the cost of unnecessary visits to remote wells and offshore platforms.

Figure 6:
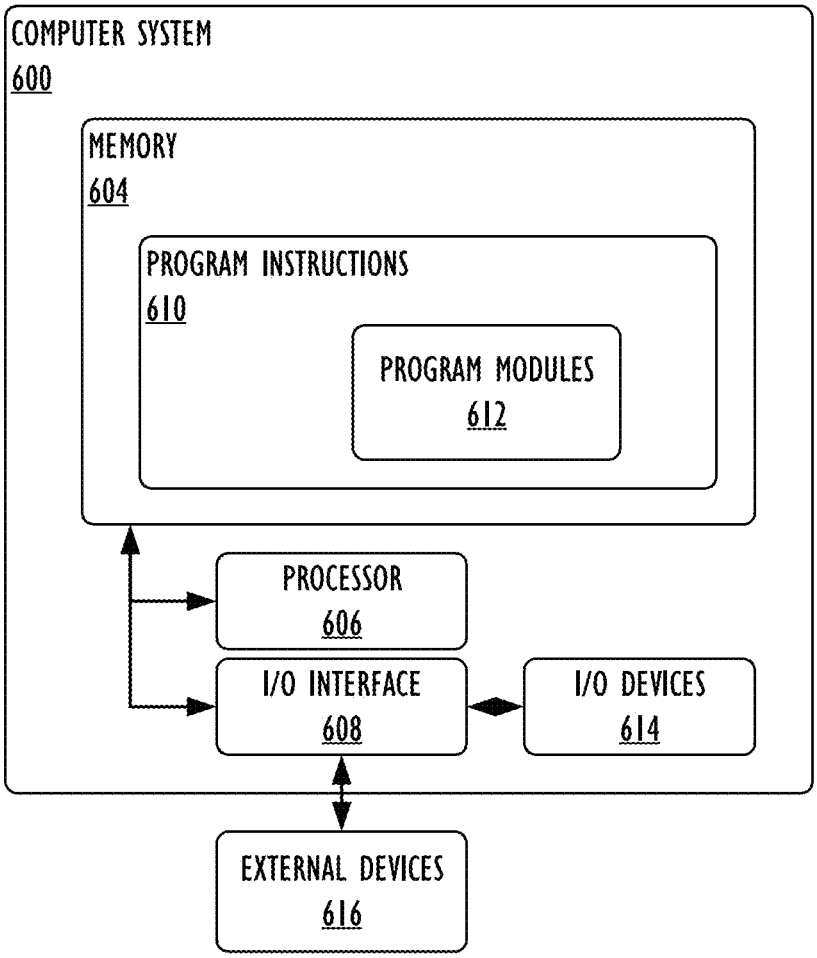
FIG. 6 is a functional block diagram of an exemplary computer system in accordance with one or more embodiments.

FIG. 6 is a functional block diagram of an exemplary computer system (or "system") 600 in accordance with one or more embodiments. In some embodiments, system 600 is a programmable logic controller (PLC). System 600 may include memory 604, processor 606 and input/output (I/O) interface 608. Memory 604 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random access memory (SRAM), synchronous dynamic RAM (SDRAM)), or bulk storage memory (e.g., CD-ROM or DVD-ROM, hard drives). Memory 604 may include a non-transitory computer-readable storage medium (e.g., non-transitory program storage device) having program instructions 610 stored thereon. Program instructions 610 may include program modules 612 that are executable by a computer processor (e.g., processor 606) to cause the functional operations described, such as those described with regard to well control system 140, annulus pressure control system 150 and 450, or method 300.

Processor 606 may be any suitable processor capable of executing program instructions. Processor 606 may include a central processing unit (CPU) that carries out program instructions (e.g., the program instructions of the program modules 612) to perform the arithmetical, logical, or input/output operations described. Processor 606 may include one or more processors. I/O interface 608 may provide an interface for communication with one or more I/O devices 614, such as a joystick, a computer mouse, a keyboard, or a display screen (for example, an electronic display for displaying a graphical user interface (GUI)). I/O devices 614 may include one or more of the user input devices. I/O devices 614 may be connected to I/O interface 608 by way of a wired connection (e.g., an Industrial Ethernet connection) or a wireless connection (e.g., a Wi-Fi connection). I/O interface 608 may provide an interface for communication with one or more external devices 616. In some embodiments, I/O interface 608 includes one or both of an antenna and a transceiver. In some embodiments, external devices 616 include logging tools, lab test systems, well pressure sensors, well flowrate sensors, or any of sensors 230 or 436 described in connection with annulus pressure control system 150 or 450.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as examples of embodiments. Elements and materials may be substituted for those illustrated and described herein, parts and processes may be reversed or omitted, and certain features of the embodiments may be utilized independently, all as would be apparent to one skilled in the art after having the benefit of this description of the embodiments. Changes may be made in the elements described herein without departing from the spirit and scope of the embodiments as described in the following claims. Headings used herein are for organizational purposes only and are not meant to be used to limit the scope of the description.

It will be appreciated that the processes and methods described herein are example embodiments of processes and methods that may be employed in accordance with the techniques described herein. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (e.g., by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means ±10% of the subsequent number, unless otherwise stated.

Use of the term "optionally" with respect to any element of a claim means that the element is required, or alternatively, the element is not required, both alternatives being within the scope of the claim. Use of broader terms such as comprises, includes, and having may be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise.

Many other embodiments will be apparent to those of skill in the art upon reviewing the above description. The scope of the subject matter of the present disclosure therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A well annulus pressure control system, comprising:

a reservoir that is in fluid communication with a well annulus of a well;

at least one control valve that is disposed on at least one fluid coupling between the reservoir and the well annulus;

at least one sensor that is configured to detect a well annulus pressure of fluid in the well annulus; and a controller that is operatively coupled to the at least one control valve and the at least one sensor, wherein the controller is configured to:

detect the well annulus pressure of the fluid in the well annulus based on sensor data from the at least one sensor;

control the at least one control valve to release the fluid from the well annulus into the reservoir in response to determining that the detected well annulus pressure is higher than a normal operating range of pressure in the well annulus;

control the at least one control valve to refill the fluid from the reservoir back into the well annulus in response to determining that the detected well annulus pressure is lower than the normal operating range of pressure in the well annulus; and control the at least one control valve to prevent flow of the fluid from the well annulus into the reservoir, and prevent flow of the fluid from the reservoir into the well annulus, in response to determining that the detected well annulus pressure is within the normal operating range.

2. The well annulus pressure control system according to claim 1, wherein the at least one control valve comprises:

a first control valve that is disposed on a first of the least one fluid couplings between the reservoir and the well annulus, wherein the first fluid coupling fluidly communicates an outlet port of the well annulus with an inlet port of the reservoir, and wherein the first control valve is a one-way valve that allows fluid to flow in a direction from the outlet port of the well annulus to inlet port of the reservoir;

a second control valve that is disposed on a second of the least one fluid couplings between the reservoir and the well annulus, wherein the second fluid coupling fluidly communicates an inlet port of the well annulus with an outlet port of the reservoir, and wherein the second control valve is a one-way valve that allows fluid to flow in a direction from the outlet port of the reservoir to the inlet port of the well annulus.

3. The well annulus pressure control system according to claim 2, wherein the inlet port of the well annulus and the outlet port of the well annulus is a same inlet/outlet port, and wherein the at least one fluid coupling further comprises a third fluid coupling having a first end that is in fluid communication with the inlet/outlet port of the well annulus, and second end that splits into two elbows, a first elbow fluidly communicated with the first fluid coupling, and a second elbow fluidly communicated with the second fluid coupling.

4. The well annulus pressure control system according to claim 2, further comprising a pump that is disposed on the second fluid coupling, wherein in response to determining that the detected well annulus pressure is lower than the normal operating range of pressure in the well annulus, the controller is configured to operate the pump and the second control valve to pump the fluid stored in the reservoir in the direction from the outlet port of the reservoir to the inlet port of the well annulus.

5. The well annulus pressure control system according to claim 1, wherein the well annulus is one of: (i) a tubing-casing annulus (TCA) of the well; (ii) a casing-casing annulus (CCA) of the well; and (iii) a combination of one or more TCAs and one or more CCAs of the well.

6. The well annulus pressure control system according to claim 1, wherein the normal operating range of pressure in the well annulus is determined based on at least one of a current operational state of the well and a current wellhead pressure in a production tubing.

7. The well annulus pressure control system according to claim 6, wherein in response to determining that the detected well annulus pressure is higher than the normal operating range of pressure in the well annulus, the controller is further configured to:

determine whether the detected well annulus pressure satisfies a predetermined high annulus pressure condition, wherein a pressure value of the predetermined high annulus pressure condition is higher than the normal operating range of pressure in the well annulus; and determine whether the detected well annulus pressure satisfies a predetermined time condition;

wherein the controller is configured to release the fluid from the well annulus into the reservoir in response to determining that the detected well annulus pressure satisfies the predetermined high annulus pressure condition and the predetermined time condition.

8. The well annulus pressure control system according to claim 7, wherein the predetermined time condition is determined to be satisfied if the detected well annulus pressure satisfies the predetermined high annulus pressure condition for a predetermined period of time.

9. The well annulus pressure control system according to claim 7, wherein the predetermined time condition is determined to be satisfied if the detected well annulus pressure remains higher than the pressure value of the predetermined high annulus pressure condition continuously for a predetermined period of time.

10. The well annulus pressure control system according to claim 7, the controller is configured to release the fluid from the well annulus into the reservoir until a predetermined release condition is satisfied, wherein the predetermined release condition is satisfied when at least one of: (i) the detected well annulus pressure becomes lower than the pressure value of the predetermined high annulus pressure condition; and (ii) the controller detects an error condition.

11. The well annulus pressure control system according to claim 10, wherein the controller detects the error condition when at least one of: (i) a fluid relief volume limit is reached; (ii) a reservoir storage limit is reached; and (iii) a time limit is reached.

12. The well annulus pressure control system according to claim 10, wherein in response to the controller detecting the error condition, the controller is further configured to transmit a notification and corresponding well behavior data to a remote operator for error handling.

13. The well annulus pressure control system according to claim 6, wherein in response to determining that the detected well annulus pressure is lower than the normal operating range of pressure in the well annulus, the controller is further configured to:

determine whether the detected well annulus pressure satisfies a predetermined low annulus pressure condition, wherein a pressure value of the predetermined low annulus pressure condition is lower than the normal operating range of pressure in the well annulus; and determine whether the detected well annulus pressure satisfies a predetermined time condition;

wherein the controller is configured to pump and refill the fluid from the reservoir into the well annulus in response to determining that the detected well annulus pressure satisfies the predetermined low annulus pressure condition and the predetermined time condition.

14. The well annulus pressure control system according to claim 13, wherein the predetermined time condition is determined to be satisfied if the detected well annulus pressure satisfies the predetermined low annulus pressure condition for a predetermined period of time.

15. The well annulus pressure control system according to claim 13, wherein the predetermined time condition is determined to be satisfied if the detected well annulus pressure remains lower than the pressure value of the predetermined low annulus pressure condition continuously for a predetermined period of time.

16. The well annulus pressure control system according to claim 13, the controller is configured to pump and refill the fluid from the reservoir into the well annulus until a predetermined refill condition is satisfied, wherein the predetermined refill condition is satisfied when at least one of: (i) the detected well annulus pressure becomes higher than the pressure value of the predetermined low annulus pressure condition; and (ii) the controller detects an error condition.

17. The well annulus pressure control system according to claim 16, wherein the controller detects the error condition when at least one of: (i) a pumping limit is reached; (ii) a reservoir storage limit is reached; and (iii) a time limit is reached.

18. The well annulus pressure control system according to claim 16, wherein in response to the controller detecting the error condition, the controller is further configured to transmit a notification and corresponding well behavior data to a remote operator for error handling.

19. The well annulus pressure control system according to claim 1, wherein the well annulus pressure control system is a rig-less system installed at a well site.

20. The well annulus pressure control system according to claim 1, wherein the fluid flowing from the well annulus into the reservoir, and from the reservoir into the well annulus, is a production fluid including hydrocarbons.

21. A well annulus pressure control method comprising:

detecting a well annulus pressure of fluid in a well annulus of a well based on sensor data from at least one sensor;

controlling at least one control valve to release the fluid from the well annulus into a reservoir in response to determining that the detected well annulus pressure is higher than a normal operating range of pressure in the well annulus;

controlling the at least one control valve to refill the fluid from the reservoir back into the well annulus in response to determining that the detected well annulus pressure is lower than the normal operating range of pressure in the well annulus; and controlling the at least one control valve to prevent flow of the fluid from the well annulus into the reservoir, and prevent flow of the fluid from the reservoir into the well annulus, in response to determining that the detected well annulus pressure is within the normal operating range.

22. The well annulus pressure control method according to claim 21, further comprising pumping the fluid from reservoir back into the well annulus in response to determining that the detected well annulus pressure is lower than the normal operating range of pressure in the well annulus.

23. The well annulus pressure control method according to claim 21, further comprising determining the normal operating range of pressure in the well annulus based on at least one of a current operational state of the well and a current wellhead pressure in a production tubing.

24. The well annulus pressure control method according to claim 23, wherein controlling at least one control valve to release the fluid from the well annulus into the reservoir further comprises:

determining whether the detected well annulus pressure satisfies a predetermined high annulus pressure condition, wherein a pressure value of the predetermined high annulus pressure condition is higher than the normal operating range of pressure in the well annulus;

determining whether the detected well annulus pressure satisfies a predetermined time condition;

controlling the at least one control valve to release the fluid from the well annulus into the reservoir in response to determining that the detected well annulus pressure satisfies the predetermined high annulus pressure condition and the predetermined time condition.

25. The well annulus pressure control method according to claim 24, wherein the predetermined time condition is determined to be satisfied if the detected well annulus pressure satisfies the predetermined high annulus pressure condition for a predetermined period of time.

26. The well annulus pressure control method according to claim 24, further comprising controlling the at least one control valve to release the fluid from the well annulus into the reservoir until a predetermined release condition is satisfied, wherein the predetermined release condition is satisfied when at least one of: (i) the detected well annulus pressure becomes lower than the pressure value of the predetermined high annulus pressure condition; and (ii) a fluid relief volume limit is reached; (iii) a reservoir storage limit is reached; and (iv) a time limit is reached.

27. The well annulus pressure control method according to claim 23, wherein controlling the at least one control valve to refill the fluid from the reservoir back into the well annulus further comprises:

determining whether the detected well annulus pressure satisfies a predetermined low annulus pressure condition, wherein a pressure value of the predetermined low annulus pressure condition is lower than the normal operating range of pressure in the well annulus;

determining whether the detected well annulus pressure satisfies a predetermined time condition; and controlling the at least one control valve to refill the fluid from the reservoir back into the well annulus in response to determining that the detected well annulus pressure satisfies the predetermined low annulus pressure condition and the predetermined time condition.

28. The well annulus pressure control method according to claim 27, wherein the predetermined time condition is determined to be satisfied if the detected well annulus pressure satisfies the predetermined low annulus pressure condition for a predetermined period of time.

29. The well annulus pressure control method according to claim 23, further comprising controlling the at least one control valve to pump and refill the fluid from the reservoir into the well annulus until a predetermined refill condition is satisfied, wherein the predetermined refill condition is satisfied when at least one of: (i) the detected well annulus pressure becomes higher than the pressure value of the predetermined low annulus pressure condition; (ii) a pumping limit is reached; (iii) a reservoir storage limit is reached; and (iv) a time limit is reached.

30. The well annulus pressure control method according to claim 21, further comprising:

drilling, during a drilling stage, the well into the reservoir using a drill bit; and producing, during a production stage, hydrocarbons from the well after completion of the drilling stage, wherein the steps of detecting the well annulus pressure, and controlling the at least one control valve based on the detected well annulus pressure, are performed during the production stage.

31. A non-transitory program storage device, readable by one or more programmable control devices and comprising instructions stored thereon that, when executed by the one or more programmable control devices, cause the one or more programmable control devices to:

detect a well annulus pressure of fluid in a well annulus of a well based on sensor data from at least one sensor;

control at least one control valve to release the fluid from the well annulus into a reservoir in response to determining that the detected well annulus pressure is higher than a normal operating range of pressure in the well annulus;

control the at least one control valve to refill the fluid from the reservoir back into the well annulus in response to determining that the detected well annulus pressure is lower than the normal operating range of pressure in the well annulus; and control the at least one control valve to prevent flow of the fluid from the well annulus into the reservoir, and prevent flow of the fluid from the reservoir into the well annulus, in response to determining that the detected well annulus pressure is within the normal operating range.

32. The non-transitory program storage device according to claim 31, wherein the instructions that cause the one or more programmable control devices to control at least one control valve to release the fluid from the well annulus into the reservoir further comprise instructions that, when executed by the one or more programmable control devices, cause the one or more programmable control devices to:

determine whether the detected well annulus pressure satisfies a predetermined high annulus pressure condition, wherein a pressure value of the predetermined high annulus pressure condition is higher than the normal operating range of pressure in the well annulus;

determine whether the detected well annulus pressure satisfies a predetermined time condition; and control the at least one control valve to release the fluid from the well annulus into the reservoir in response to determining that the detected well annulus pressure satisfies the predetermined high annulus pressure condition and the predetermined time condition.

33. The non-transitory program storage device according to claim 31, wherein the instructions that cause the one or more programmable control devices to control the at least one control valve to refill the fluid from the reservoir back into the well annulus further comprise instructions that, when executed by the one or more programmable control devices, cause the one or more programmable control devices to:

determine whether the detected well annulus pressure satisfies a predetermined low annulus pressure condition, wherein a pressure value of the predetermined low annulus pressure condition is lower than the normal operating range of pressure in the well annulus;

determine whether the detected well annulus pressure satisfies a predetermined time condition; and control the at least one control valve to refill the fluid from the reservoir back into the well annulus in response to determining that the detected well annulus pressure satisfies the predetermined low annulus pressure condition and the predetermined time condition.

* * * * *